US008002124B2

(12) United States Patent
Lin et al.

(10) Patent No.: US 8,002,124 B2
(45) **Date of Patent: *Aug. 23, 2011**

(54) TOOL RACK SET FASTENER

(75) Inventors: Pei-Ying Lin, Taichung Hsien (TW); Chanwa Nguy, Cornelius, NC (US)

(73) Assignee: Steelworks Hardware, LLC, Northbrook, IL (US)

( * ) Notice: Subject to any disclaimer, the term of this patent is extended or adjusted under 35 U.S.C. 154(b) by 451 days.

This patent is subject to a terminal disclaimer.

(21) Appl. No.: 11/577,783

(22) PCT Filed: Apr. 26, 2005

(86) PCT No.: PCT/US2005/014353

§ 371 (c)(1),
(2), (4) Date: Sep. 3, 2008

(87) PCT Pub. No.: WO2006/046967

PCT Pub. Date: May 4, 2006

(65) Prior Publication Data

US 2009/0114783 A1 May 7, 2009

(51) Int. Cl.
*A47F 7/00* (2006.01)

(52) U.S. Cl. ..... 211/70.6; 211/183; 248/201; 206/372; 220/23.2

(58) Field of Classification Search ..... 248/201; 211/70.6, 78, 183; 24/625; 312/245, 215, 312/222; 206/372, 373, 509; 403/326, 329; 220/23.2, 23.4, 23.85

See application file for complete search history.

(56) References Cited

U.S. PATENT DOCUMENTS

| | | | | |
|---|---|---|---|---|
| 3,648,849 | A | 3/1972 | Harris et al. | |
| 4,150,464 | A * | 4/1979 | Tracy | 24/313 |
| 4,712,280 | A * | 12/1987 | Fildan | 24/625 |
| 4,825,515 | A * | 5/1989 | Wolterstorff, Jr. | 24/625 |
| 4,991,272 | A * | 2/1991 | Bianchi | 24/616 |
| 5,144,725 | A * | 9/1992 | Krauss | 24/625 |
| 5,383,257 | A * | 1/1995 | Krauss | 24/625 |
| 5,697,507 | A * | 12/1997 | Blass | 211/94.01 |
| 5,737,810 | A * | 4/1998 | Krauss | 24/625 |
| 5,806,822 | A | 9/1998 | Schulz | |
| 5,967,340 | A * | 10/1999 | Kao | 211/70.6 |
| 6,092,656 | A * | 7/2000 | Ernst | 206/378 |
| 6,299,000 | B1 * | 10/2001 | Cabrera | 211/70.2 |
| 6,431,373 | B1 * | 8/2002 | Blick | 211/70.6 |
| 6,536,613 | B2 * | 3/2003 | Shea | 211/87.01 |
| 6,834,767 | B1 * | 12/2004 | Lin | 211/70.6 |
| 6,854,607 | B2 * | 2/2005 | Tong | 211/70.6 |
| 7,080,733 | B2 * | 7/2006 | Kao | 206/372 |
| 7,111,368 | B2 * | 9/2006 | Matoba | 24/615 |
| 2003/0019775 | A1 * | 1/2003 | Ernst | 206/378 |
| 2003/0024837 | A1 * | 2/2003 | Chen | 206/378 |
| 2003/0070999 | A1 * | 4/2003 | Kao | 211/70.6 |

(Continued)

FOREIGN PATENT DOCUMENTS

FR 2761127 9/1998

*Primary Examiner* — Kimberly T Wood

(74) *Attorney, Agent, or Firm* — Levenfeld Pearlstein, LLC

(57) ABSTRACT

Disclosed is a tool rack set fastener, which includes a first fastening structure, which has mounting base fixedly fastened to a vertical wall or upright support and a coupling unit formed integral with the mounting base, and a second fastening structure, which is connectable to a tool rack set to secure the tool rack set to the first fastening structure and has a coupling base connectable to the coupling unit of the first fastening structure.

17 Claims, 6 Drawing Sheets

U.S. PATENT DOCUMENTS

2003/0141211 A1* 7/2003 Tsai ..... 206/378
2003/0213760 A1* 11/2003 Lee ..... 211/70.6
2004/0188366 A1 9/2004 Tong
2005/0076483 A1* 4/2005 Chen ..... 24/615
2005/0230335 A1* 10/2005 Chiu et al. ..... 211/70.6
2007/0102381 A1* 5/2007 Nguy et al. ..... 211/70.6

* cited by examiner

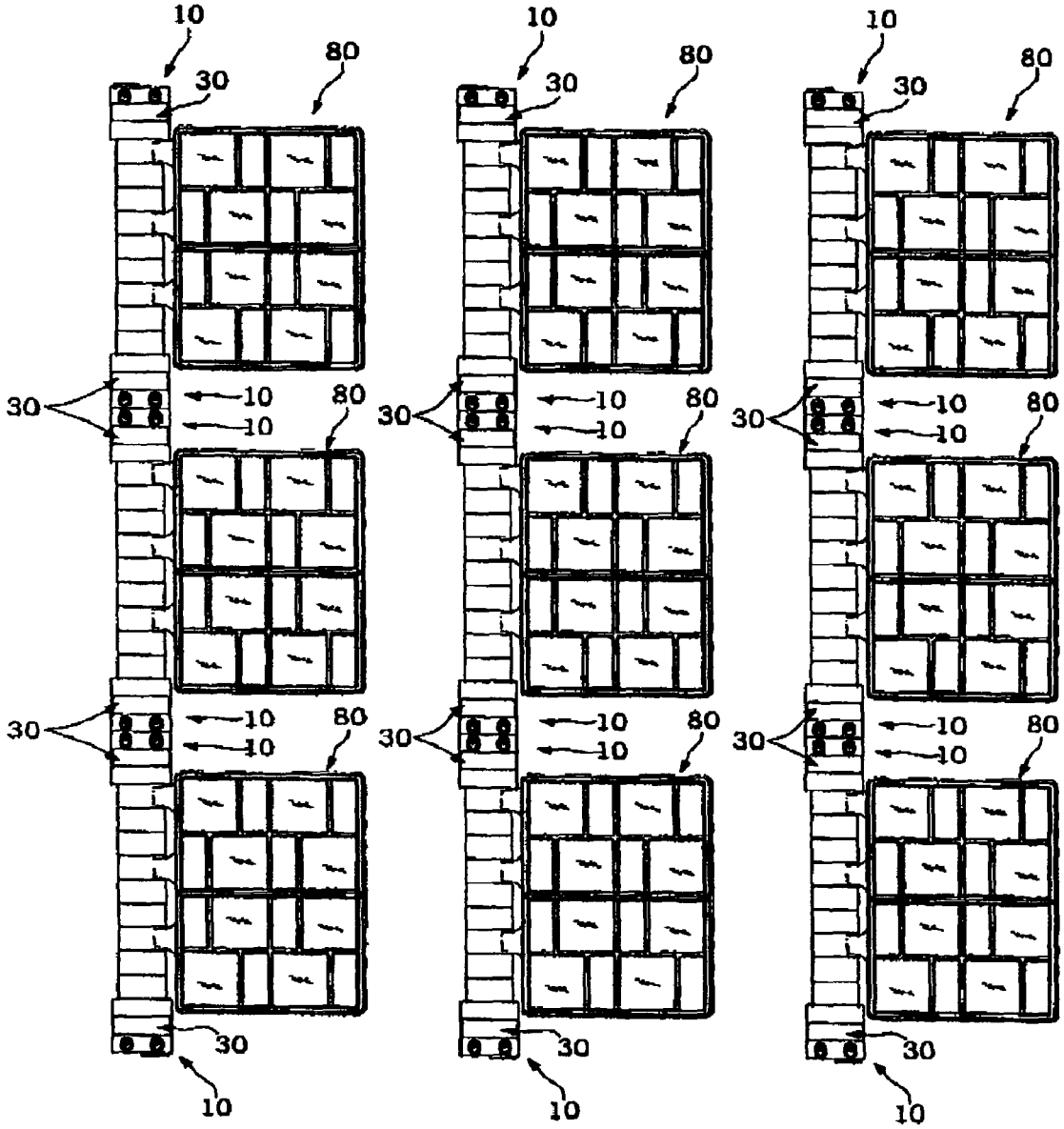
10
30
80
10
10
30
80
10
10
30
80
10

TOOL RACK SET FASTENER

BACKGROUND OF THE INVENTION

1. Field of the Invention

This application claims the benefit of the Republic of China (Taiwan) Application No. 053132335, filed on Oct. 26, 2004.

The present invention relates to tool rack set device and more specifically, to a tool rack set fastener for fastening a tool rack set to a vertical wall or upright support.

2. Description of the Related Art

Tool racks are commonly used for keeping tools, parts and accessories. When several tool racks are used, the user may directly put the tool racks and/or tools on the floor and, therefore, the tools may become lost, unorganized, or have a higher incidence of breakage. In order to avoid these problems, the user may attempt to arrange the tool racks in a stack.

SUMMARY OF THE INVENTION

The present invention overcomes the above problems encountered in the prior art. The instant invention is a tool rack set fastener. The inventor provides a secure means for a tool rack to attach to a vertical wall or upright support. The present invention also provides a tool rack set fastener having a reinforced structure to allow for support of a heavy load of tools on a vertical wall or upright support. Furthermore, the present invention provides a tool rack set fastener, which is detachable. The present invention provides a tool rack set fastener saving floor space. The tool rack fastener comprises a first fastening structure. The first fastening structure comprises a mounting base fastened to a vertical support and a coupling unit; and a second fastening structure connectable to a tool rack set for securing the tool rack set to the first fastening structure, the second fastening structure comprising a coupling base connectable to the coupling unit of the first fastening structure. The coupling unit of the first fastening structure comprises a center shaft and two locking bars equally spaced from the center shaft at two sides. The coupling base of the second fastening structure is comprised of a hollow member having a plurality of partition walls, a center receiving chamber for receiving the center shaft, and two side receiving chambers separated from the center receiving chamber at two sides by the partition walls for receiving the locking bars. Further, a coupling structure is provided at the mounting base of the first fastening structure so that the mounting bases of the first fastening structure of a plurality of tool rack set fasteners can be fastened together to hold a plurality of tool rack sets at different elevations. The first fastening structures each have a rear end respectively terminating at a back wall of the coupling unit. The back wall of the coupling unit is being formed integral with the front wall of the mounting base.

BRIEF DESCRIPTION OF THE DRAWINGS

FIG. 8 is a top view of FIG. 7 of several tool rack sets.

DETAILED DESCRIPTION OF THE PREFERRED EMBODIMENT

Figure 1:
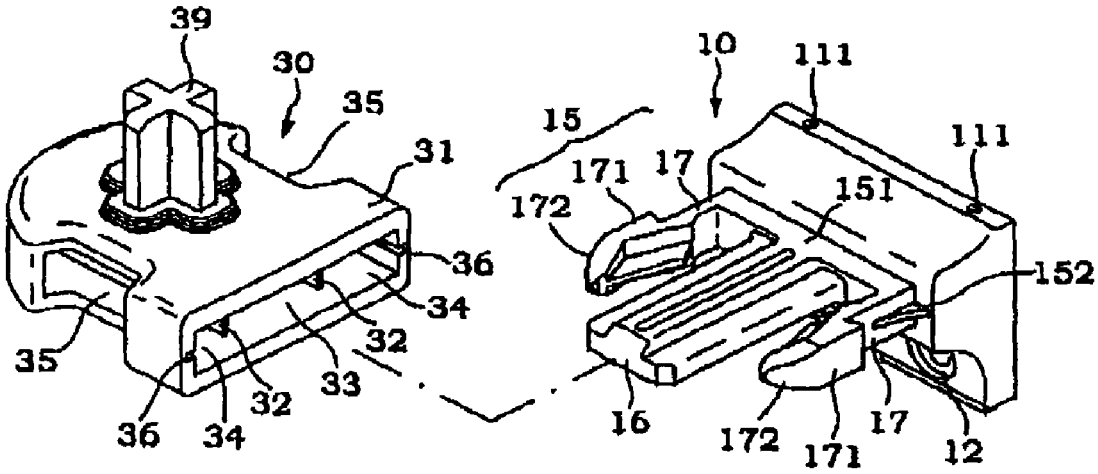
FIG. 1 is an exploded view of a tool rack set fastener according to the present invention.
Figure 2:
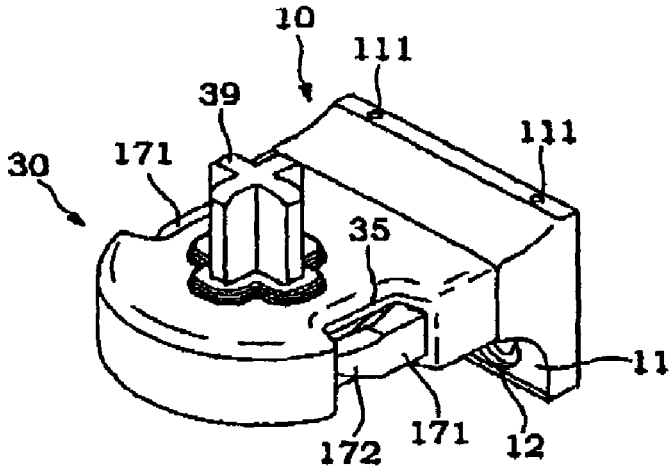
FIG. 2 is a perspective assembly view of the tool rack set fastener according to the present invention.
Figure 3:
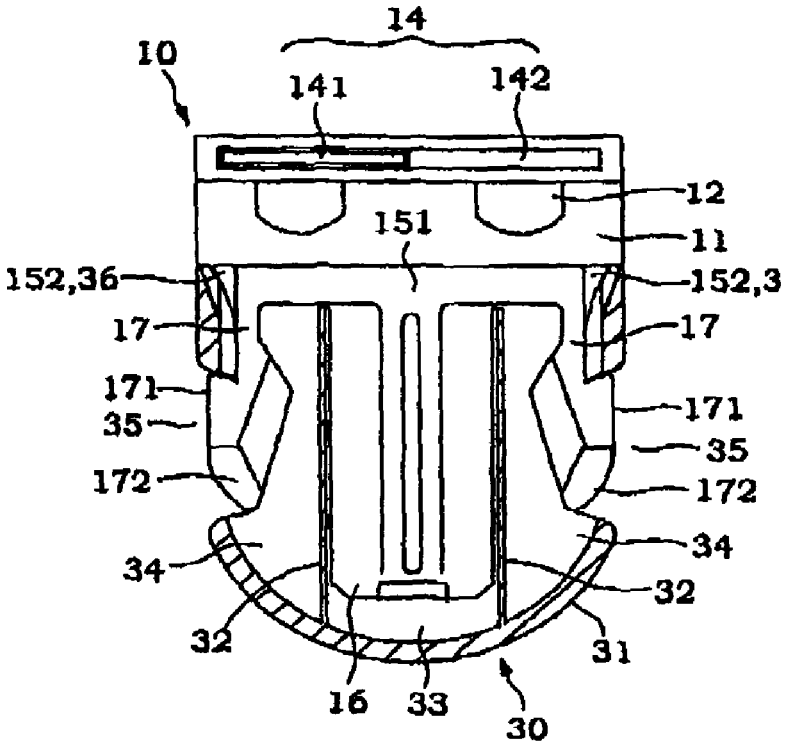
FIG. 3 is a cross sectional view of FIG. 2.
Figure 6:
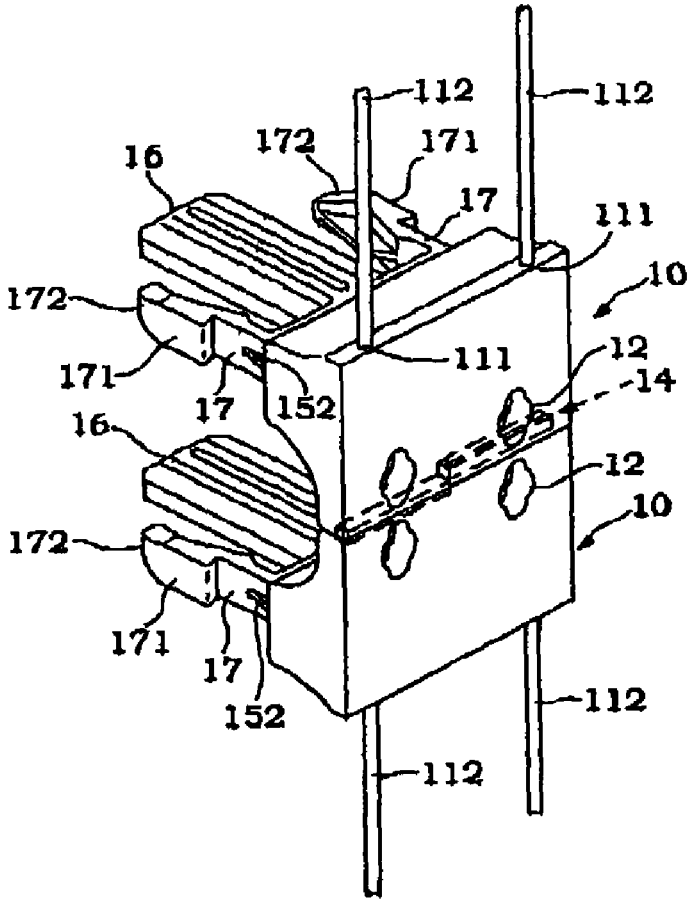
FIG. 6 shows a plurality of a tool rack set fasteners secured to a plurality of wire rods and fastened together according to the present invention.

FIGS. 1 and 2 illustrate a tool rack set fastener in accordance with the present invention comprising a first fastening structure 10 and a second fastening structure 30 detachably fastened together for securing a tool rack set to a vertical wall or upright support.

As shown in FIG. 1, the first fastening structure 10 comprises a mounting base 11 for fastening to a vertical wall or upright support, and a coupling unit 15 detachably connectable to the second fastening structure 30. The mounting base 11 has a plurality of mounting apertures, for example, countersunk apertures 12 for the mounting of a fastening structure, such as, screws 13 (see FIG. 4) to affix the first fastening structure 10 to a vertical wall or upright support. The coupling unit 15 integrally formed with the front wall of the mounting base 11, comprises a center guide shaft 16 and a plurality of spring locking bars 17 equally spaced from the center guide shaft 16 at two sides. Each spring locking bar 17 has a front hooked portion 171. The front hooked portion 171 has a front guide face 172 sloping forwardly inwards toward the center guide shaft 16.

Figure 4:
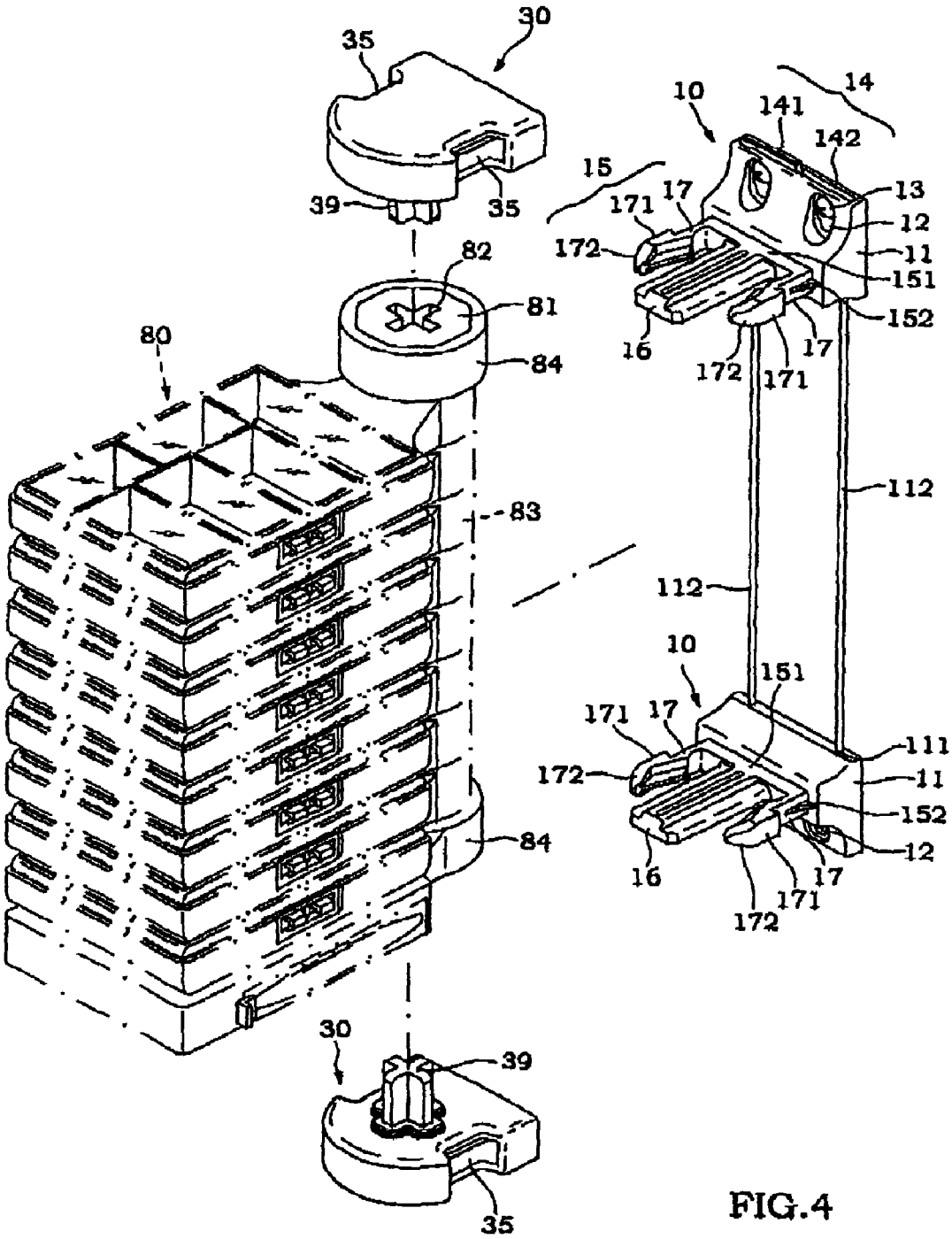
FIG. 4 is an exploded view showing one application example of the present invention.

As shown in FIGS. 1 and 2, the second fastening structure 30 comprises a coupling base 31 adapted to receive the coupling unit 15 of the first fastening structure 10, and a plug rod 39 for fastening to a tool rack set 80 (see FIG. 4). The coupling base 31 is a hollow member having the inside space separated by partition walls 32 into a center receiving chamber 33 and two side receiving chambers 34 for receiving the center guide shaft 16 and locking bars 17 of the first fastening structure 10 respectively, and two locking apertures 35 formed in the two opposite lateral sidewalls in communication with the side receiving chambers 34 for engagement with the front hooked portions 171 of the locking bars 17 of the first fastening structure 10. By means of the guide of the front guide face 172 of each of the locking bars 17, the locking bars 17 of the first fastening structure 10 can be easily guided into the side receiving chambers 34 of the second fastening structure 30 to force the front hooked portion 171 of each of the locking bars 17 into engagement with the locking apertures 35 of the second fastening structure 30. Further, when releasing the second fastening structure 30 from the first fastening structure 10, the user can squeeze or pinch the front hooked portions 171 of the two locking bars 17 inwards toward the inside of the coupling base 31 of the second fastening structure 30 to disengage the locking apertures 35 from the locking bars 17.

Figure 5:
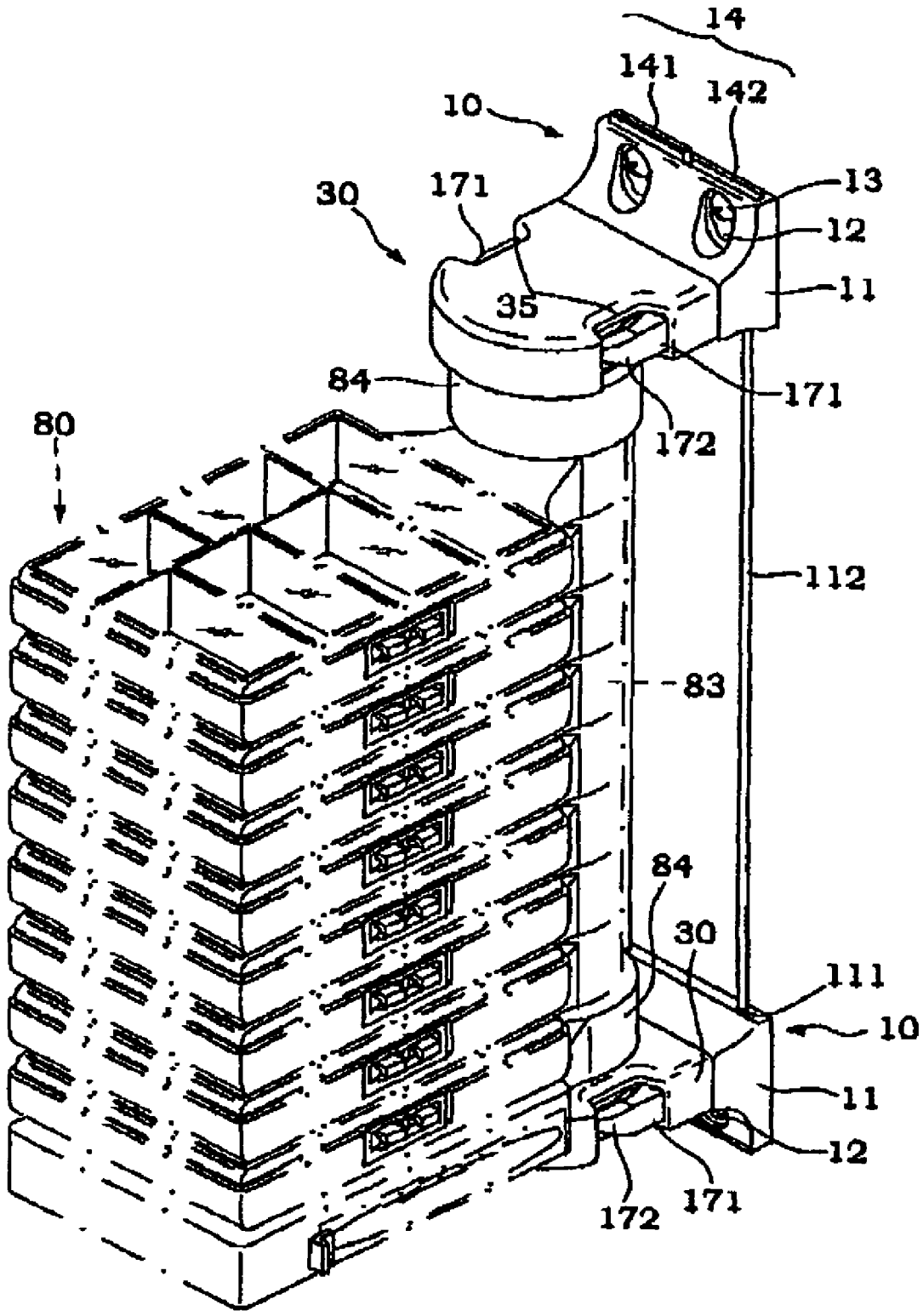
FIG. 5 is an assembly view of FIG. 4.
Figure 7:
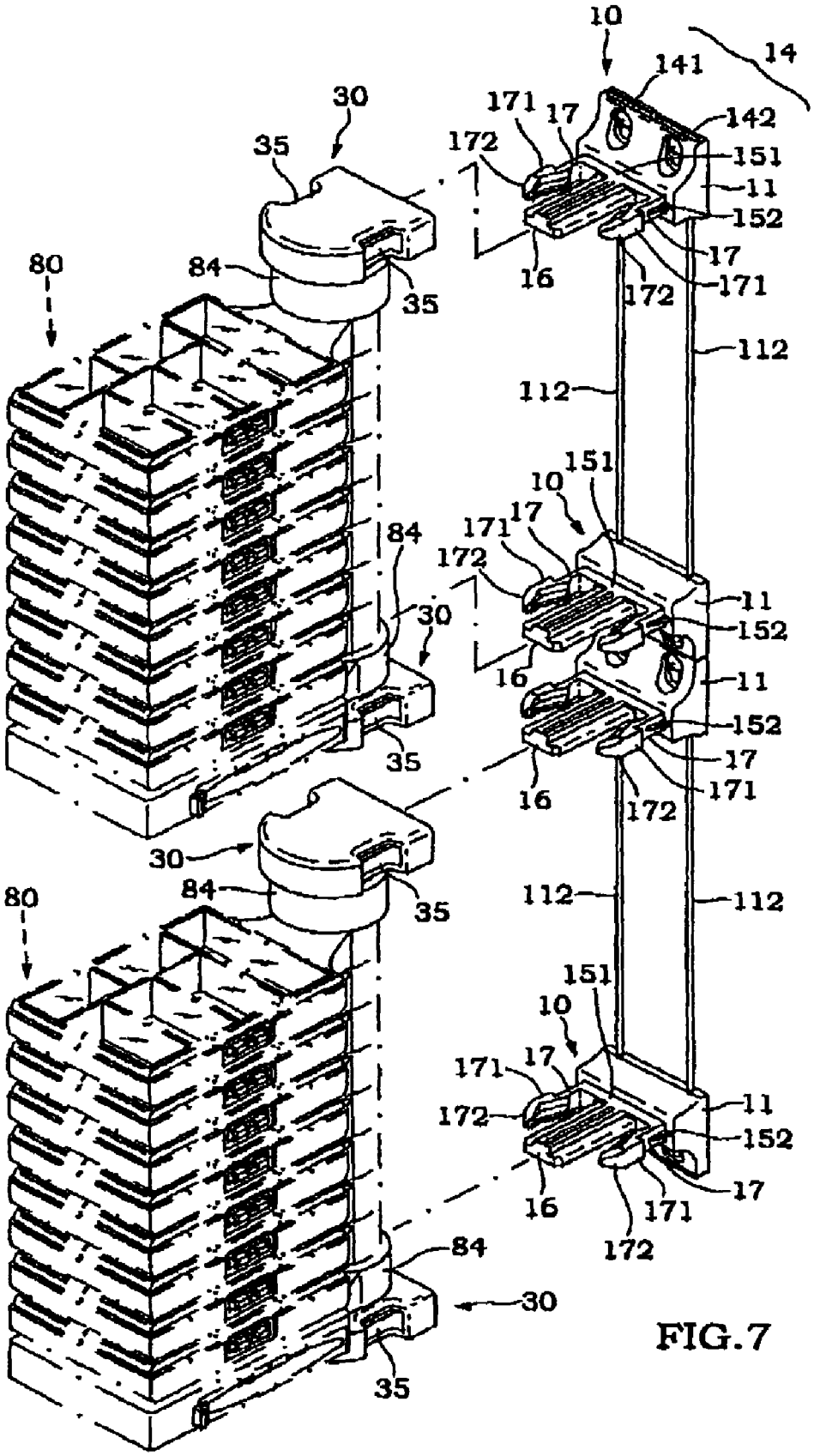
FIG. 7 is the same as FIG. 4, except two tool rack sets are fastened together.

As shown in FIGS. 1 and 2, the coupling unit 15 has a back wall 151 formed integrally with the front wall of the mounting base 11, and a plurality of triangular reinforcing blocks 152 connected between two sides of the back wall 151 and the front wall of the mounting base 11 to reinforce the structural strength of the back wall 151 against the load after installation of the tool rack set fastener to secure the tool rack set 80 to a vertical wall or upright support (see FIG. 5). The coupling base 31 has a plurality of locating grooves 36 respectively disposed inside the side receiving chambers 34 for receiving the triangular reinforcing blocks 152 upon insertion of the locking bars 17 into the side receiving chambers 34. Further, the partition walls 32 serve as reinforcing means to reinforce the structural strength of the second fastening structure 30.

FIGS. 4 and 5 illustrate the tool rack set 80 comprising a pivot shaft 83, and two end caps 84 respectively capped on the top and bottom ends of the pivot shaft 83. Each end cap 84 has a coupling wall 81 and a plughole 82 formed in the coupling wall 81 for receiving the plug rod 39 of the second fastening structure 30.

According to the application example of the present invention as shown in FIGS. 4 and 5, a plurality of tool rack set fasteners are used and respectively fastened to the plug apertures 82 of the two end caps 84 of the tool rack set 80 to secure the tool rack set 80 to a vertical wall or upright support. Further, two wire rods 112 may be used to hold a plurality of tool rack fasteners together for quick installation. Usually, the wire has a length equal to the heights of the tool rack set to be fastened.

As illustrated in FIGS. 1, 2, 4, and 5, the mounting base 11 of the first fastening structure has a plurality of parallel apertures 111 extending through the top and bottom sides thereof for receiving the wire rods 112. The diameter of the apertures 111 is equal to or greater than the diameter of the wire rods 112. After insertion of the wire rods 112 into the apertures 111 of the mounting base 11 of each tool rack set fastener, a plurality of tool rack set fasteners can be moved along the wire rods 112 to fit the size of the tool rack set 80.

As shown in FIGS. 3 and 6-8, the mounting base 11 has a coupling structure 14, which comprises tenon 141 and a mortise 142. By means of fastening the tenon 141 of the first fastening structure 10 of one tool rack set fastener to the mortise 142 of the first fastening structure 10 of another tool rack set fastener, a plurality of tool rack set fasteners are fastened together. Therefore, the instant invention can be used to fasten a number of tool rack sets to a vertical wall or upright support at different elevations.

A tool rack set fastener has been constructed with the features illustrated in FIGS. 1-8. This tool rack set operates as described herein.

Various modifications to the invention are contemplated. It is understood, therefore, that within the scope of the appended claims, the invention may be practiced otherwise than specifically described.

We claim:

1. A tool rack set fastener comprising:

a first fastening structure, said first fastening structure comprising a mounting base fastened to vertical support, and a coupling unit; and a second fastening structure connectable to a tool rack set for securing the tool rack set to said first fastening structure, said second fastening structure comprising a coupling base connectable to the coupling unit of said first fastening structure, wherein the coupling unit of the first fastening structure comprises a center shaft and a plurality of locking bars equally spaced from the center shaft at two sides, the coupling base of the second fastening structure is a hollow member having a plurality of partition walls, a center receiving chamber for receiving the center shaft, and two side receiving chambers separated from the center receiving chamber at two sides by the partition walls for receiving the locking bars, and wherein each locking bar of the first fastening structure includes a front hooked portion, the front hooked portion having a front guide face sloping forwardly inwards toward the center guide shaft, the coupling base of the second fastening structure has two locking apertures formed in a plurality of opposite lateral sidewalls thereof in communication with the side receiving chambers for engagement with the front hooked portions of the locking bars respectively.

2. The tool rack set fastener of claim 1, wherein said center shaft and said locking bars of said coupling unit of said first fastening structure each have a rear end respectively terminating at a back wall of said coupling unit, the back wall of said coupling unit being formed integral with a front wall of said mounting base.

3. The tool rack set fastener of claim 2, wherein said first fastening structure further comprises a plurality of reinforcing blocks bilaterally connected between the back wall of said coupling unit and the front wall of said mounting base; said coupling base of said second fastening structure has a plurality of locating grooves respectively formed in said side receiving chambers for receiving said reinforcing blocks of said first fastening structure.

4. The tool rack set fastener of claim 1, wherein said mounting base of said first fastening structure comprises two mounting apertures for fastening to said vertical support with fastening structure.

5. The tool rack set fastener of claim 1, wherein said mounting base of said first fastening structure comprises a coupling structure for enabling a plurality of mounting bases of the first fastening structure to be fastened together in vertical.

6. The tool rack set fastener of claim 5, wherein said coupling structure comprises a tenon and a mortise.

7. The tool rack set fastener of claim 1, wherein said mounting base of said first fastening structure has at least one aperture respectively mounted with a wire rod.

8. The tool rack set fastener of claim 7, wherein said wire rod has a length equal to the height of the tool rack set to be fastened.

9. A tool rack set fastener comprising:

at least one pair of first fastening structure respectively fastened to vertical support at different elevations and aligned in a line, each said first fastening structure comprising a mounting base fixedly fastened to said vertical support, and a coupling unit; and at least one pair of second fastening structure for securing at least one tool rack set to said at least one pair of first fastening structure, each said second fastening structure comprising a coupling base connectable to the coupling unit of said first fastening structure, wherein the coupling unit of each said first fastening structure comprises a center shaft and two locking bars equally spaced from said center shaft at two sides; the coupling base of each said second fastening structure is a hollow member having a plurality of partition walls, a center receiving chamber for receiving the center shaft of one said first fastening structure, two side receiving chambers separated from said center receiving chamber at two sides by said partition walls for receiving the locking bars of one said first fastening structure.

10. The tool rack set fastener of claim 9, wherein each said locking bar of each said first fastening structure comprises a front hooked portion, said front hooked portion having a front guide face sloping forwardly inwards toward said center guide shaft; the coupling base of each said second fastening structure has two locking apertures formed in two opposite lateral sidewalls thereof in communication with said side receiving chambers for engagement with the front hooked portions of the locking bars of one said first fastening structure respectively.

11. The tool rack set fastener of claim 9, wherein said center shaft and said locking bars of said coupling unit of each said first fastening structure each have a rear end respectively terminating at a back wall of said coupling unit, the back wall of said coupling unit being formed integral with a front wall of said mounting base.

12. The tool rack set fastener of claim 11, wherein each said first fastening structure further comprises a plurality of reinforcing blocks bilaterally connected between the back wall of said coupling unit and the front wall of said mounting base; said coupling base of each said second fastening structure has two locating grooves respectively formed in said side receiving chambers for receiving said reinforcing blocks of one said first fastening structure.

13. The tool rack set fastener of claim 9, wherein said mounting base of each said first fastening structure comprises two mounting apertures for fastening to said vertical support with fastening structure.

14. The tool rack set fastener of claim 9, wherein said mounting base of each said first fastening structure comprises a coupling structure for enabling a plurality of mounting bases of the first fastening structure to be fastened together.

15. The tool rack set fastener of claim 14, wherein said coupling structure comprises a tenon and a mortise.

16. A tool rack set fastener, comprising:

at least one pair of first fastening structures respectively fastened to a vertical support at different elevations and aligned in a line, each said first fastening structure comprising a mounting base fixedly fastened to said vertical support, and a coupling unit; and at least one pair of second fastening structures for securing at least one tool rack set to said at least one pair of first fastening structures, each said second fastening structure comprising a coupling base connectable to the coupling unit of said first fastening structure, wherein said mounting base of each said first fastening structure has at least one aperture respectively mounted with a wire rod.

17. The tool rack set fastener of claim 16, wherein said wire rod has a length equal to the height of the tool rack set to be fastened.

* * * * *